US005465922A

United States Patent [19]

Vander Groef

[11] Patent Number: 5,465,922

[45] Date of Patent: Nov. 14, 1995

[54] MANDREL WITH SELF-ALIGNING FLANGE

[75] Inventor: Lawrence Vander Groef, North Haledon, N.J.

[73] Assignee: Communication Cable, Inc., Sanford, N.C.

[21] Appl. No.: 96,429

[22] Filed: Jul. 26, 1993

[51] Int. Cl.[6] ..... B65H 75/24

[52] U.S. Cl. ..... 242/573

[58] Field of Search ..... 242/573, 573.9, 242/571, 597.2, 597.4; 279/2.11, 2.12, 2.14, 2.15; 269/48.1, 48.2, 48.3, 48.4; 82/169

[56] References Cited

U.S. PATENT DOCUMENTS

| | | | |
|---|---|---|---|
| 1,969,530 | 8/1934 | Snyder | 242/573 |
| 2,662,701 | 12/1953 | Weber | 242/573 |
| 2,789,779 | 4/1957 | Loop | 242/573.9 |

*Primary Examiner*—John M. Jillions

*Attorney, Agent, or Firm*—Rhodes, Coats & Bennett

[57] ABSTRACT

The present invention entails a mandrel for a winding machine having a fixed flange that is adapted to be secured to a spindle of the winding machine. A core is secured to one end of the fixed flange and includes a plurality of core segments that are pivotally connected at one end to this fixed flange and include a series of projections at the opposite end and wherein the core segments are movable between expanded and collapsed positions. The mandrel further includes a removable flange having a circumferential groove adapted to mate with the projections on the core segments when the core segments are in the expanded position. Finally, the mandrel includes a guide member mounted to the inner surface of the removable flange for engaging the core segments and moving the core segments to the expanded position when the removable flange is moved in an axial direction towards the fixed flange so that the projections on the core segments are aligned with the circumferential groove in the removable flange.

14 Claims, 6 Drawing Sheets

MANDREL WITH SELF-ALIGNING FLANGE

FIELD OF THE INVENTION

The present invention relates generally to winding machines for winding wire or cable, and more particularly to a mandrel for a winding machine having a removable flange.

BACKGROUND OF THE INVENTION

Winding machines for winding a wire or cable are well-known. Typically, a winding machine includes a spindle on which a mandrel is mounted to rotate the mandrel, and a traverse which reciprocates along a path parallel to the axis of the spindle to guide the wire or cable onto the rotating mandrel. The mandrel itself typically includes a collapsible core and two end flanges. After the wire or cable is wound onto the mandrel, one of the end flanges is removed and the core collapses so that the wire can be removed from the mandrel.

One problem with prior art mandrels is that it is sometimes difficult and cumbersome to realign the end flange with the core segments when reinstalling the end flange. This difficulty arises from the fact that the flange typically includes milled slots which must be properly aligned with the core segments. If the end flange is not properly aligned with the core segments, then the two pieces will not fit together.

SUMMARY AND OBJECTS OF THE INVENTION

The present invention relates to a mandrel for a winding machine having a self-aligning flange. The mandrel includes a fixed flange and a removable flange. The fixed flange is fixedly secured to the spindle of a winding machine. The removable flange may, for example, be mounted to the arm of a loading mechanism on the winding machine. A plurality of individual core segments are pivotally secured to the fixed flange. The core segments are movable between an expanded position when the removable flange is mounted, and a collapsed position when the removable flange is removed. A biasing means causes the core segments to assume the collapsed position each time the removable flange is removed.

The removable flange includes a continuous, circumferential groove which is adapted to mate with the core segments. A guide cone is mounted to the inside surface of the removable flange which causes the core segments to be moved from the collapsed position to the expanded position as the removable flange is moved axially toward the fixed flange. The core segments engage the inclined surface of the guide cone and spread apart as the removable flange is pushed inwardly. The biasing means assures that the guide core segments will remain engaged with the surface of the cone. In the preferred embodiment of the invention, the core segments have rollers which contact the surface of the cone to reduce the amount of friction.

Based on the foregoing, it is a primary object of the present invention to provide a self-aligning mechanism for a mandrel having a removable flange for automatically aligning the collapsible core segments with a mating groove in the removable flange.

Another object of the present invention is to provide a mandrel for a winding machine having a removable flange which can be easily and quickly installed thereby increasing productivity and reducing cost of operation.

Other objects and advantages of the present invention will become apparent and obvious from a study of the following description and the accompanying drawings which are merely illustrative of such invention.

DETAILED DESCRIPTION OF THE INVENTION

Figure 1:
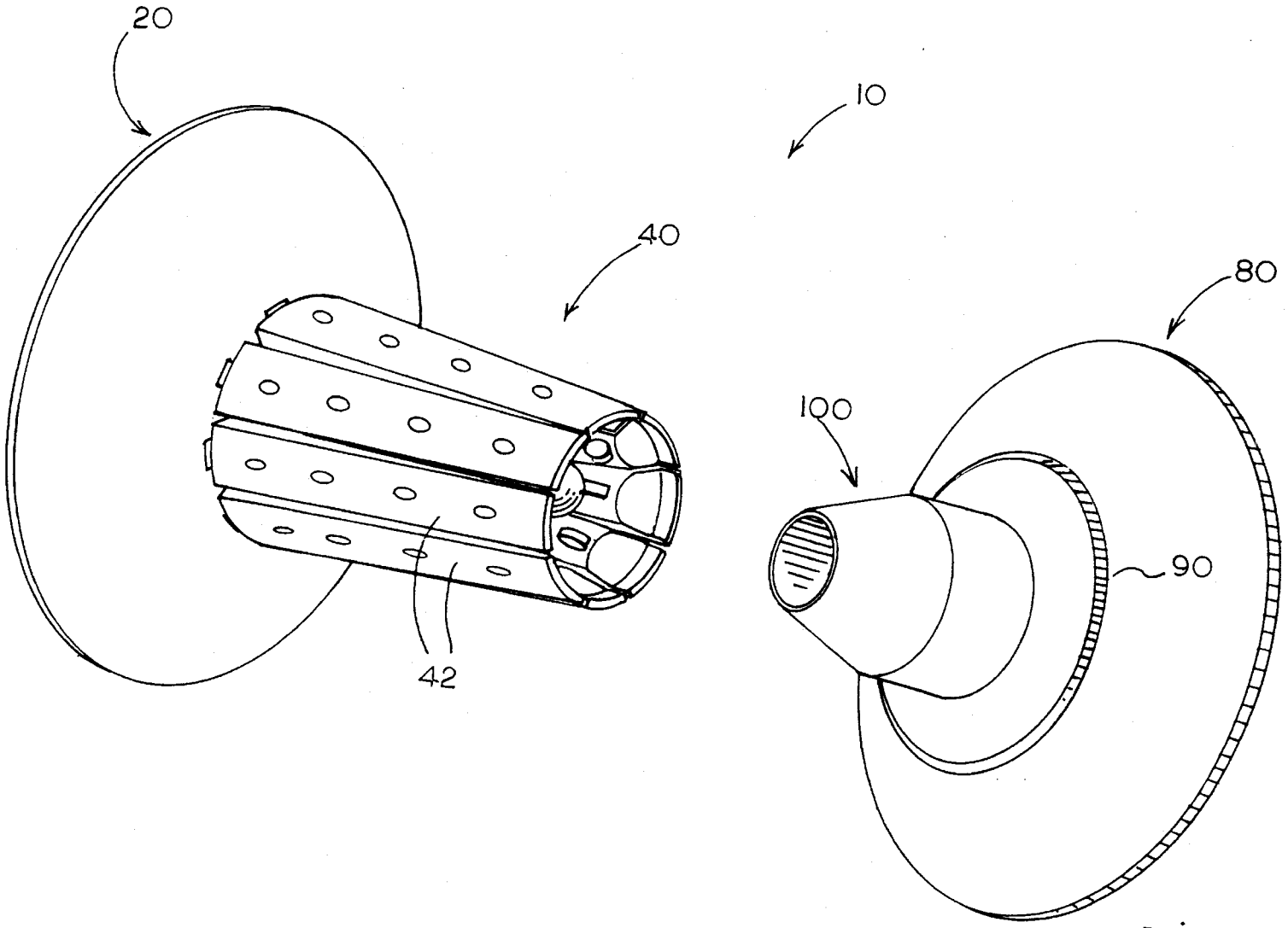
FIG. 1 is a perspective view of the mandrel of the present invention.

Referring now to tile drawings, and particularly to FIG. 1, the mandrel of the present invention is shown therein and indicated generally by the numeral 10. The mandrel 10 generally comprises a fixed flange 20, a removable flange 80, and a core 40. The fixed flange 20 is adapted to be fixedly secured to the spindle 12 of a winding machine. (See FIGS. 6 and 7) The removable flange 80 is adapted to be mounted on the stub shaft 14 of a loading arm. The loading arm is a component of the winding machine for automatically loading and unloading the removable flange 80. It will be appreciated, however, that the removable flange 80 could be loaded and unloaded manually.

Figure 2:
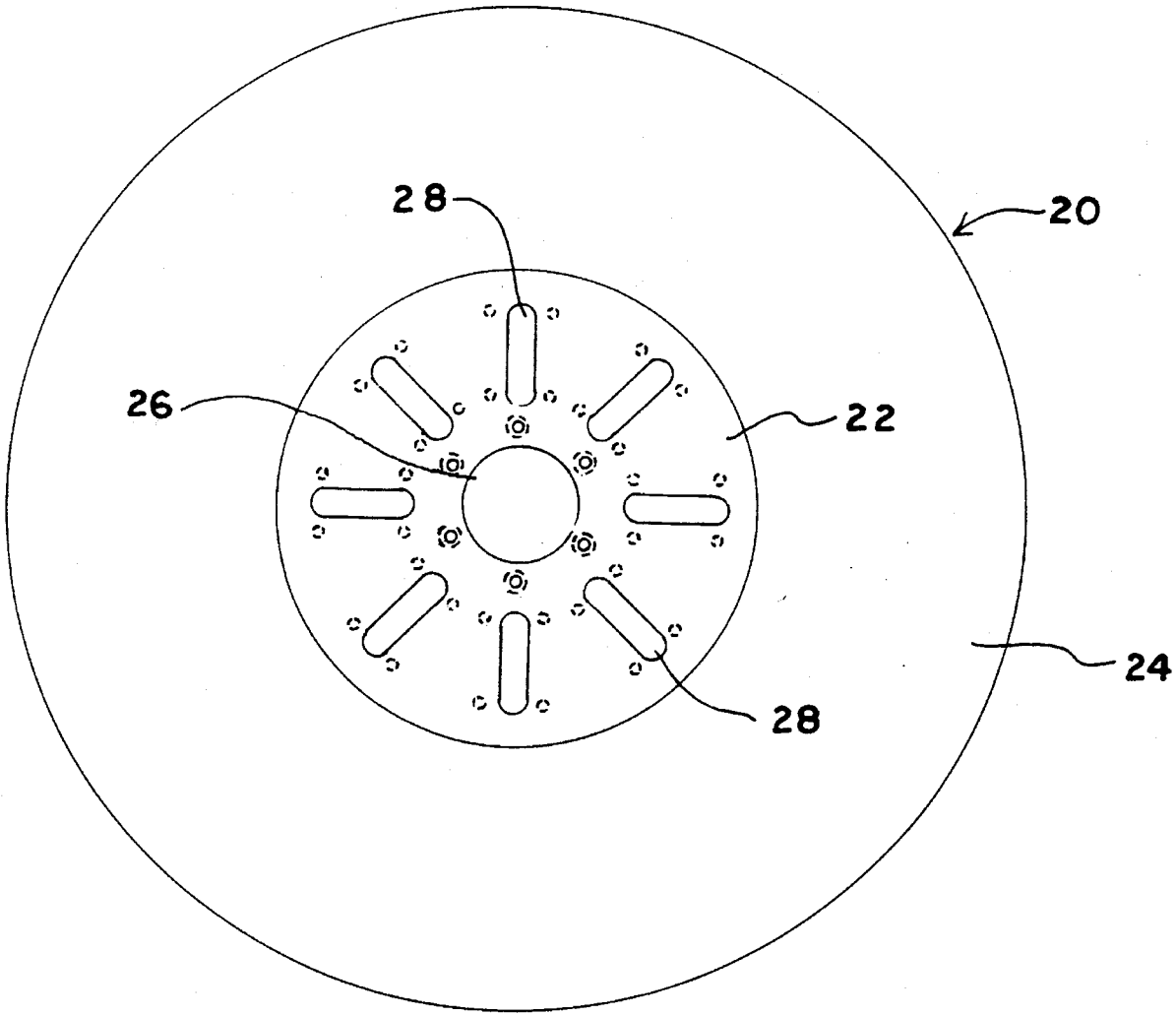
FIG. 2 is an elevation view of the fixed flange from the inside.

Referring now to FIG. 2, the fixed flange 20 has a circular configuration and includes a generally flat central section 22 of uniform thickness, and a tapered outer section 24 which is formed by milling the inside surface of the flange 20. The central section 22 includes a spindle opening 26 adapted to receive the spindle 12 of the winding machine. A plurality of radially-extending slots 28 are disposed in the central section 22 around the spindle opening 26. In the described embodiment, eight radial slots 28 are shown, although this number may vary. A plurality of throughbores 30 are disposed circumferentially around the spindle opening 26 for securing the flange 20 to a drive sleeve 32. A total of six throughbores 30 are shown in the figures although this number may also vary.

Figure 3:
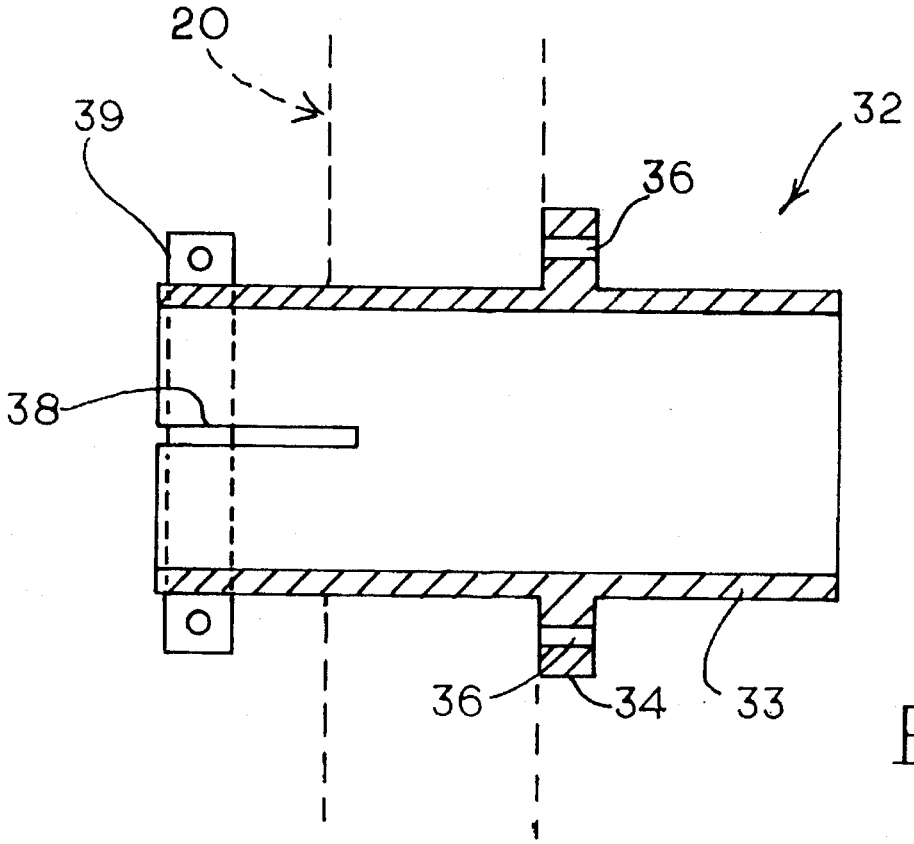
FIG. 3 is a cross-section of the drive sleeve.

The drive sleeve 32, shown in FIG. 3, includes a tubular member 33 and a radially extending flange 34. A plurality of threaded bolt holes 36 are formed in the flange 34 which align with the throughbores 30 in the fixed flange 20. A plurality of bolts 37 extend through the fixed flange 20 and threadably engage the bolt holes 36 to secure the drive sleeve 32 to the fixed flange 20. A pair of diametrically opposed slots 38 are formed in one end of the tubular member 33. A split-ring collar 39 clamps around the slotted end of the tubular member 33 to secure the drive sleeve 32 to the spindle 12.

Figure 6:
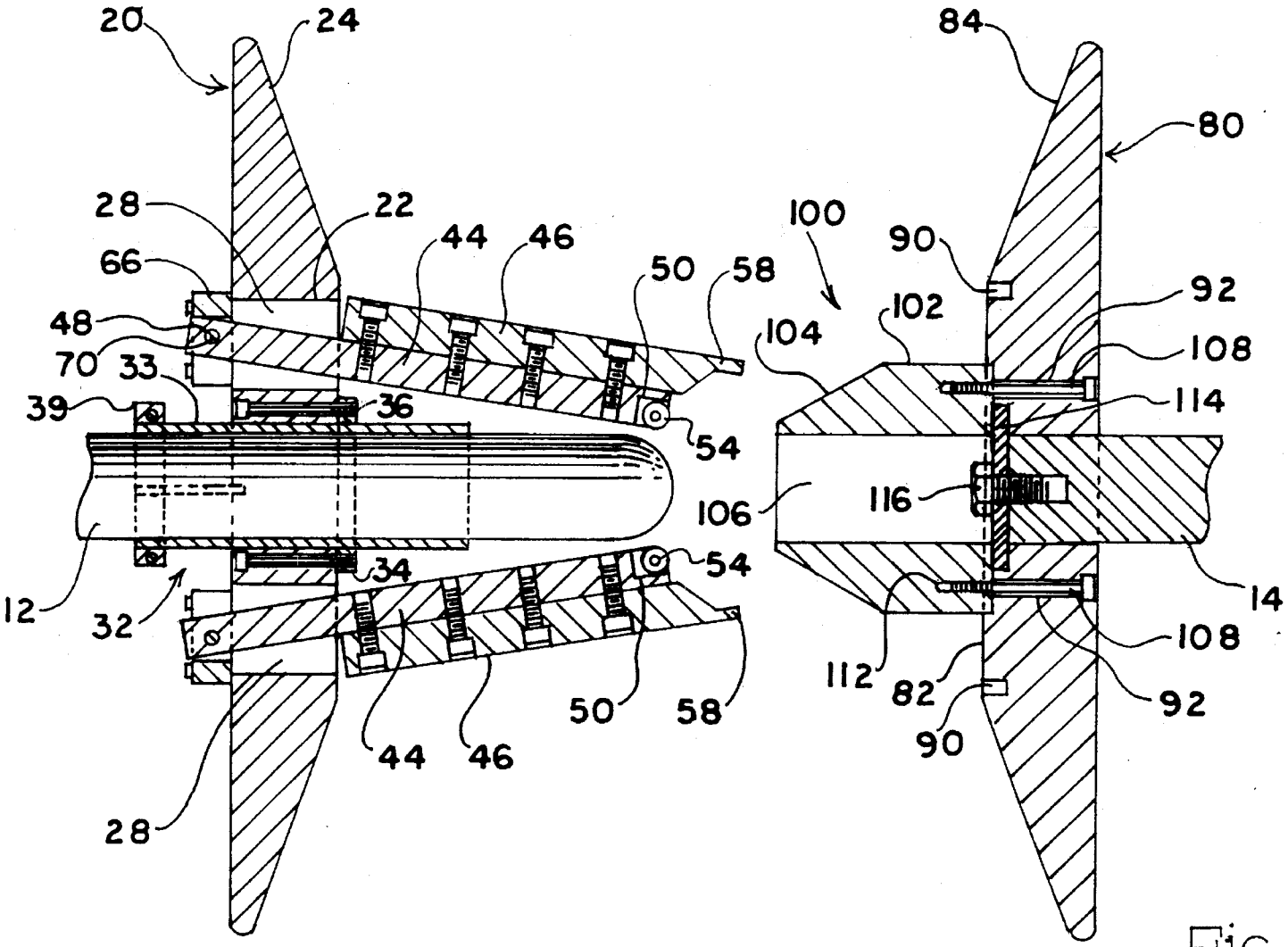
FIG. 6 is a longitudinal-section view of the mandrel with the removable flange removed.
Figure 7:
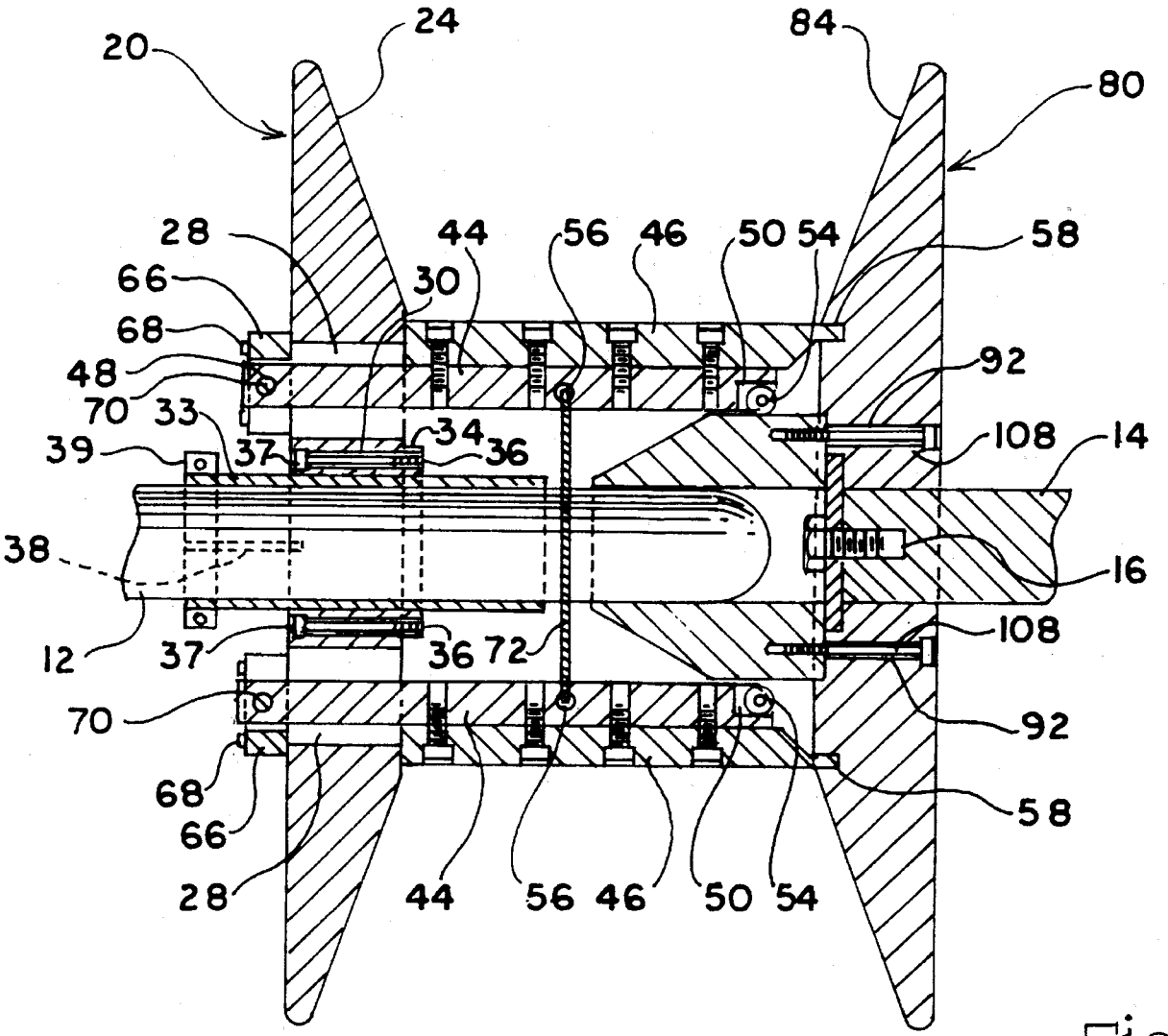
FIG. 7 is a longitudinal-section view of the mandrel with the removable flange mounted.

The core 40 comprises a plurality of individual core segments 42. The core segments 42, in turn, are comprised of a pivot member 44 and a core piece 46. The core segments 42 are pivotally attached to the fixed flange 20 so as to be movable between a collapsed position as shown in FIG. 6 and an expanded position as shown in FIG. 7.

The pivot member 44 is a generally rectangular member having a pivot hole 48 at one end thereof. A roller cavity 50 is formed in the end opposite the pivot hole 48. An axle opening 52 extends transversely through the walls of the roller cavity 50. A roller 54 is rotatably mounted in the roller cavity 50. The diameter of the roller 54 is such that the perimeter of the roller 54 extends below the bottom edge of the pivot member 44.

Figure 4:
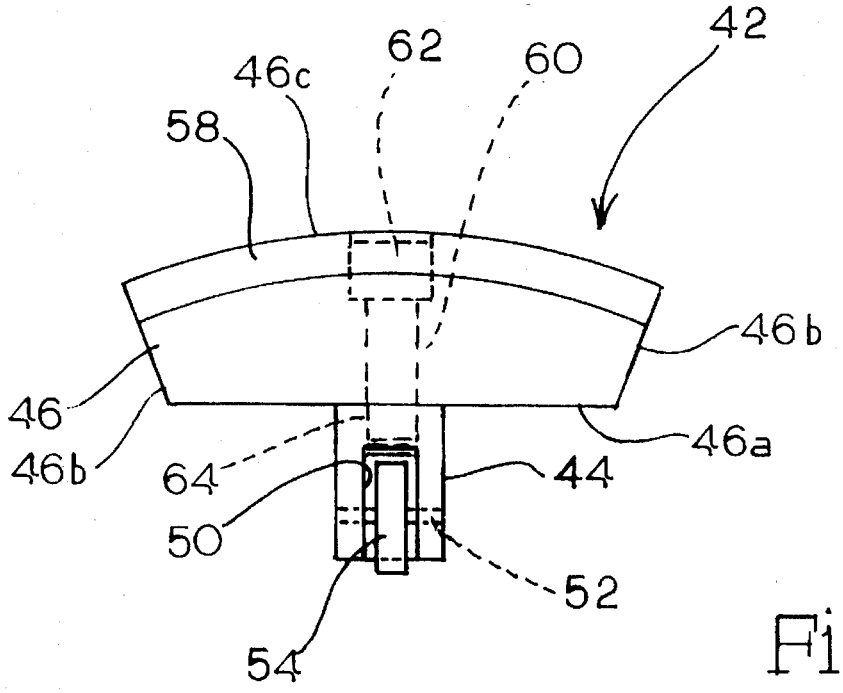
FIG. 4 is a cross-section of a core segment.

Each core piece 46 has a generally trapezoidal configuration when viewed in cross section. (See FIG. 4) The core piece 46 includes a generally flat bottom surface 46*a*, inclined side walls 46*b*, and a curved outer surface 46*c*. The outer surface 46*c* is preferably grooved, etched, or otherwise provided with some surface texture to help prevent the line from slipping. The radius of the outer surface 46*c* will coincide with the radius of the core in an uncollapsed state. An arcuate tongue 58 projects from a forward end of the core piece 46 which mates with the removable flange 80 as will be hereinafter described.

A plurality of throughbores 60 are disposed along a longitudinal axis of the core piece 46. Bolts 62 extend through the core piece 46 and threadably engage with threaded bolt holes 64 in the pivot member 44 to secure each core piece 46 on a corresponding pivot member 44.

The core segments 42 are pivotally mounted to the fixed flange 20. A generally U-shaped mounting block 66 is bolted to the outer surface of the fixed flange 20. The pivot member 44 is secured to the mounting block 66 by a pivot pin 70 which passes through the pivot hole 48 in the end of the pivot member 44.

The individual core segments 42 collectively define a cylindrical surface on which the wire or line is wound. Each core segment 42 is moveable in a radial direction between a collapsed position as shown in FIG. 6 and an expanded position as shown in FIG. 7. To bias the core segments 42 to the collapsed position, a biasing member 72 is attached to each pivot member 44. Each pivot member is formed with an opening 56 through which the biasing member 72 extends. The biasing member 72 could comprise a tension spring formed into a ring, or a continuous band formed of rubber or other elastomeric material.

Figure 5:
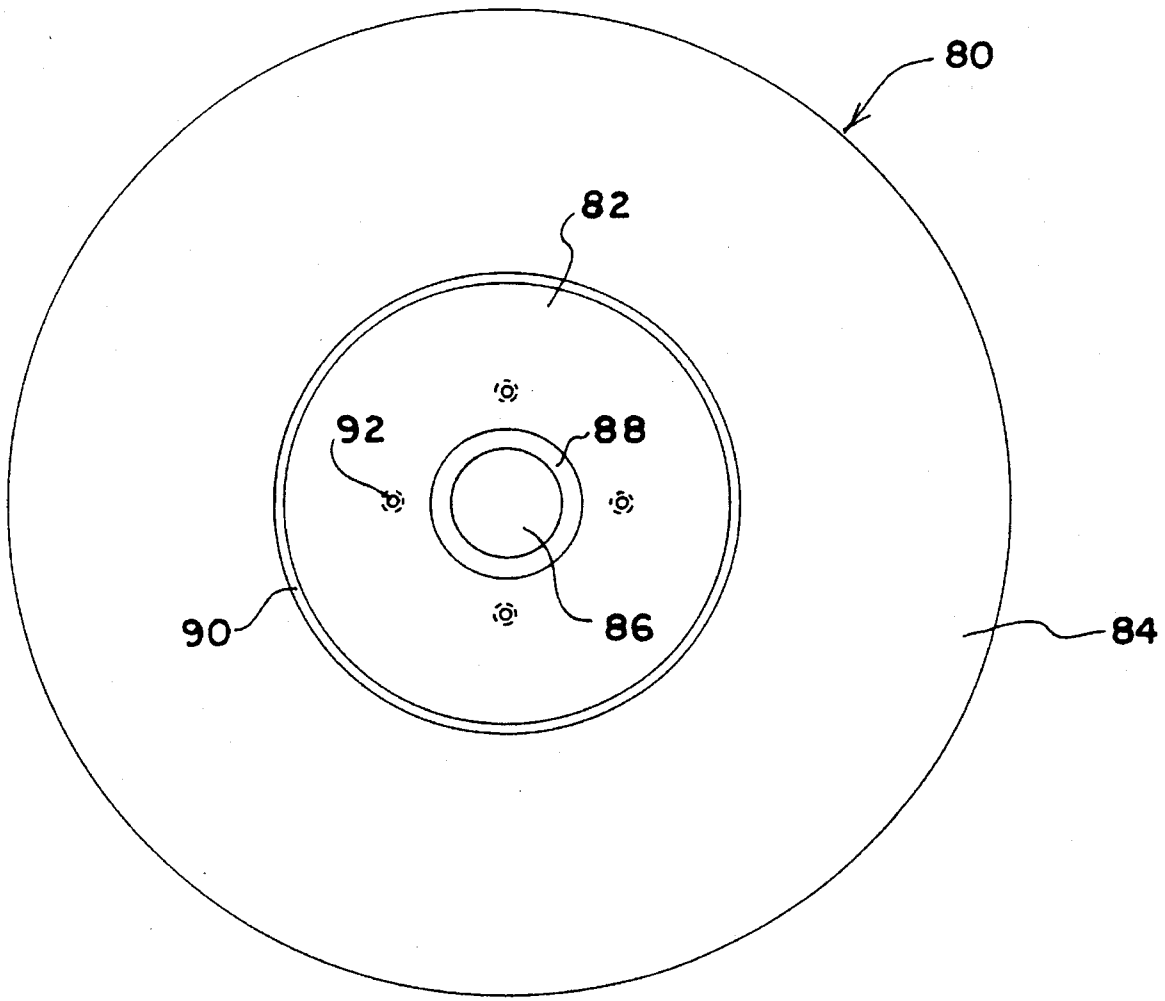
FIG. 5 is an elevation view of the removable flange from the inside.

The removable flange 80, shown in FIG. 5, is similar in shape to the fixed flange 20. Removable flange 80 includes a generally flat central section 82 and a tapered outer section 84 which is formed by milling the inside surface of the flange 80. An opening 86 is formed in the center of the flange 80 to receive a stub shaft 14. A shoulder 88 of slightly larger diameter than the opening 86 is formed on the inner surface of the flange 80 and extends around the opening 86. A circumferential groove 90 is formed at the outer edge of the central section 82 concentric with the opening 86. The circumferential groove 90 is continuous and is adapted to receive the tongue 58 on each of the core segments 42.

The flange 80 is adapted to be mounted to the stub shaft 14 of a loading arm. The stub shaft 14 extends into the central opening 86 of the flange 80. (See FIGS. 6 and 7) The stub shaft 14 includes a threaded opening 16 extending along the axis thereof. A washer 114 is secured to the end of the stub shaft 14 by a bolt 116 and bears against the shoulder 88 to secure the flange 80 on the stub shaft 14.

To properly align the tongue 58 on each of the core segments 42 with the circumferential groove 90, a guide cone 100 is mounted to the inner surface of the flange 80. The guide cone 100 has a generally cylindrical base section 102 and a tapered nose section 104. The cone 100 also has an axial opening 106 for receiving the end of the spindle 12.

The guide cone 100 is mounted to the flange 80 by a plurality of bolts 108. The bolts 108 extend through throughbores 92 in the central section 82 of the flange 80, and are threadably engaged with bolt holes 112 in the base section 102 of the guide cone 100.

To use the mandrel 10 of the present invention, the fixed flange 20 is mounted on the spindle 12 of the winding machine by bolting the drive sleeve 32 to the fixed flange 20 and then clamping the drive sleeve 32 to the spindle 12. The removable flange 80 is then moved towards the fixed flange 20 along the axis of the spindle 12. The removable flange 80 can be moved either manually or by automated means such as the loading arm of a winding machine. As the removable flange 80 is moved axially towards the fixed flange 20, the rollers 54 on the end of each core segment 42 engage the tapered nose section 104 of the guide cone 100 and begin to ride along the surface of the nose section 104. The nose section 104 causes the core segments 42 to spread apart as the rollers 54 ride up the nose section 104. When the rollers 54 ride up onto the base section 102 of the guide cone 100, the tongues 58 on each of the core segments 42 will be radially aligned with the circumferential groove 90 in the flange 80. The rollers 54 will continue to ride along the surface of the base section 102 until the tongue 58 on each of the core segments 42 mates with the circumferential groove 90.

During a winding operation, inwardly directed pressure is applied to the removable flange 80 to maintain it in engagement with the core segments 42. The frictional engagement between the tongue 58 and the groove 90 is sufficient to transfer torque to the removable flange 80.

When the winding operation is completed, the removable flange 80 is moved away from the fixed flange 20. As the removable flange 80 is moved away from the fixed flange 20, the biasing member 72 causes the core segments 42 to collapse radially inwardly as the rollers 54 ride down the nose section 104. Thus, when the removable flange 80 is removed, the wound package can be easily removed from the core 40.

Based on the foregoing, it is apparent that the core segments 42 will automatically align with the groove 90 in the removable flange 80 whenever the removable flange 80 is mounted. There is no need to manually align parts in order to fit the end flange onto the mandrel. Thus, the mandrel 10 of the present invention is less cumbersome to use than prior art mandrels.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A mandrel for a winding machine comprising:

(a) a first flange adapted to be fixedly secured to a spindle of a winding machine;

(b) a core including a plurality of individual core segments pivotally secured at one end to the first flange and having a projection at the opposite end, said core segments being moveable between an expanded position and a collapsed position;

(c) a removable flange having a circumferential groove adapted to mate with the projections on the core segments when the core segments are in an expanded position;

(d) a guide member mounted to the inner surface of the removable flange, said guide member including an inclined surface for engaging the core segments and moving the core segments to the expanded position when the removable flange is moved in an axial direction towards the fixed flange so that the projections on the core segments are aligned with the circumferential groove in the removable flange; and (e) a roller mounted on each of the core segments for engaging the inclined surface of the guide member.

2. The mandrel according to claim 1 further including a biasing member for biasing the core segments to the collapsed position.

3. The mandrel according to claim 2 wherein the biasing member is a spring.

4. The mandrel of claim 1 wherein the first flange has a series of circumferentially disposed, radially extending slots, and each of the individual core segments extends through a respective slot in the first flange and is pivotally attached to an outboard side of the first flange.

5. The mandrel of claim 1 wherein the guide member comprises a cone.

6. A mandrel for a winding machine, comprising:

(a) a fixed flange having a spindle opening and connectable to a spindle of a winding machine, (b) an elongated core movable between a collapsed position and an expanded position, the core including a plurality of core segments having a first end and a second end, wherein the first end of each core segment is pivotally connected to the fixed flange, and wherein the core segments pivot on the first flange as the core is moved between the collapsed and expanded positions such that the second ends of the core segments move radially inward and outward between an expanded position and a collapsed position;

(c) a removable flange having a continuous, circumferential groove for mating with the second end of each core segment when the core segments are in the expanded position;

(d) positioning means for moving the core segments from the collapsed to the expanded position, the positioning means comprising a guide cone having a cylindrical base section and a conical nose section extending from the base section, wherein the nose section is shaped to move the second ends of the core segments outwardly to the expanded position as the removable flange is moved axially toward the fixed flange; and (e) a roller positioned on the second end of each core segment for contacting the cone, wherein the rollers move along the cone as the removable flange is moved axially toward the fixed flange.

7. The mandrel of claim 6 further including a drive sleeve having a radially extending flange for securing the drive sleeve to the fixed flange and a tubular member for securing the drive sleeve to the spindle.

8. The mandrel of claim 7 wherein the core is biased to a collapsed position.

9. The mandrel of claim 8 wherein the second ends of the core segments frictionally engage with tile continuous groove when the core is in the expanded position such that the second flange rotates with the first flange.

10. The mandrel of claim 9 wherein the cone section includes an opening sized to receive the spindle extended within the core.

11. A collapsible mandrel for attachment to a spindle of a winding machine, comprising:

(a) first and second flanges, the first flange having defined therethrough a series of circumferentially disposed, radially extending slots;

(b) a collapsible core including a plurality of core segments, each of the core segments including a pivot end that extends through a respective slot in the first flange; and (c) a plurality of pivot attachments for attaching the pivot ends of the core segments to an outboard side of the first flange, whereby the core segments move radially within the slots between a collapsed position and an expanded position.

12. The mandrel of claim 11 further comprising core expanding means mounted to the second flange for radially expanding the collapsible core as the second flange is moved axially toward the first flange.

13. The mandrel of claim 12 wherein the expanding means includes an inclined surface for engaging the core segments and pivoting the core segments about the pivot attachments into the expanded position.

14. The mandrel of claim 13 further comprising a roller mounted on each of the core segments for engaging the inclined surface.

* * * * *